United States Patent [19]

Primas

[11] 4,155,701

[45] May 22, 1979

[54] VARIABLE CAPACITY BURNER ASSEMBLY

[75] Inventor: Alex L. Primas, Norristown, Pa.

[73] Assignee: The Trane Company, La Crosse, Wis.

[21] Appl. No.: 836,337

[22] Filed: Sep. 26, 1977

[51] Int. Cl.[2] ..... F23M 9/00

[52] U.S. Cl. ..... 431/183; 239/405; 239/416.5; 431/185

[58] Field of Search ..... 431/182, 183, 184, 185; 239/399, 401, 404, 405, 406, 407, 416.4, 416.5

[56] References Cited

U.S. PATENT DOCUMENTS

| | | | |
|---|---|---|---|
| 1,329,279 | 1/1920 | Voorheis | 431/183 |
| 1,341,524 | 5/1920 | Stahlgren | 431/183 |
| 1,449,840 | 3/1923 | Reid | 431/183 |
| 1,576,537 | 3/1926 | Peabody | 431/183 |
| 2,216,508 | 10/1940 | Zink | 431/185 X |
| 2,757,721 | 8/1956 | Reed et al. | 431/183 |
| 3,723,049 | 3/1973 | Juricek | 431/183 |
| 3,922,137 | 11/1975 | Peczeli et al. | 431/183 |

*Primary Examiner*—Edward G. Favors

*Attorney, Agent, or Firm*—Peter D. Ferguson; Carl M. Lewis

[57] ABSTRACT

A variable capacity burner assembly for the combustion of a fuel-air mixture is disclosed which includes a combustion air supply housing having spaced front and rear walls and including an opening in said front wall for the discharge of combustion air into a combustion zone. Disposed within the housing are a plurality of plate-like air directing vanes arranged in a circular array such that combustion air passing therethrough has a rotary, swirling motion imparted thereto prior to its discharge into the combustion zone. Flow control means for varying the volume of combustion air passing through said vanes are provided which include a generally planar baffle member having a circular array of slots therein corresponding to the array of air directing vanes, which vanes are in registry with said slots. The baffle member is supported within the housing for axial displacement between a first position wherein combustion air flow through the vanes is limited to a minimum value, and a second position wherein maximum combustion air flow through said vanes is effected.

16 Claims, 7 Drawing Figures

VARIABLE CAPACITY BURNER ASSEMBLY

BACKGROUND OF THE INVENTION

1. Field of the Invention

The present invention relates generally to the field of burners for the combustion of fuel-air mixtures such as are utilized in a wide variety of industrial applications. Specifically, the invention is addressed to that type of burner wherein air is supplied to a combustion zone after having a rotary, swirling motion imparted thereto so as to provide turbulence for the mixing of fuel and air, thereby effecting intense and efficient combustion.

In burners of this type, it is often desirable that the burner be designed so as to operate over a fairly wide range of required heat output. In doing so, however, it is necessary that suitable combustion air flow control means be provided so as to maintain effectiveness of the rotary, swirling motion imparted to the air at reduced flow rates. The present invention provides a means for effectively varying the capacity of such a burner between a maximum rated value and a value equal to as low as 10% of its rated capacity.

2. Description of the Prior Art

U.S. Pat. No. 1,341,524 discloses a hydrocarbon burner wherein a circular array of air directing vanes acts upon combustion air prior to its admission to a combustion zone and wherein a movable shutter 60 is provided for varying the amount of air passing through said vanes. Shutter 60 comprises a circular, planar member disposed entirely inside the array of air turning vanes, which vanes have inner edge portions lying parallel to the direction in which shutter 60 reciprocates.

U.S. Pat. No. 2,757,721 discloses a second burner assembly which includes a circular array of air directing vanes wherein a desired flame pattern may be produced by selectively positioning a cylindrical baffle 61 which surrounds the array and a generally circular baffle 48 which lies at the interior of said array.

U.S. Pat. No. 1,329,279 discloses a burner assembly also having a circular array of air directing vanes wherein the entire vane assembly is movable with respect to a stationary shroud encircling said array, whereby the volume of air flowing through the vanes to a combustion zone may be varied.

SUMMARY OF THE INVENTION, OBJECTS

The present invention comprises a variable capacity burner assembly for the combustion of a fuel-air mixture wherein a combustion air supply housing is provided having spaced front and rear walls and side wall means extending therebetween to form an enclosed chamber. Combustion air is admitted to the housing through a suitable opening and discharged therefrom through an opening in said front wall to a combustion zone. In order to impart a rotary, swirling motion to the combustion air before its discharge into the combustion zone, a plurality of plate-like air directing vanes are disposed within the enclosed chamber. These vanes are arranged in a circular array about a reference axis which extends from a central portion of the front wall opening toward the rear wall. The surface of each said vane lies generally tangentially with respect to the surface of an imaginary circular cylinder lying along the aforementioned reference axis, thereby producing the above-described rotary, swirling motion.

In order to vary the volume of combustion air passing through the vanes to said opening, flow control means are provided which include a generally planar baffle member disposed substantially perpendicular to the reference axis having a circular array of slots therein corresponding to the array of directing vanes, which are in registry with the slots of the baffle member. The baffle member is supported within the housing for axial displacement between a first position adjacent the front wall of the housing wherein combustion air flow through the vanes is limited to a minimum value, and a second position spaced from said front wall wherein maximum combustion air flow through said vanes is effected.

In addition to the generally planar baffle member, a cylindrical baffle member may also be provided and attached to a peripheral portion of the planar baffle member, extending axially towards the rear wall of the housing in surrounding relationship to the circular array of air directing vanes. Suitable means are provided for mounting the array of vanes within the combustion air supply housing and for suitably positioning the baffle members so as to provide a desired combustion air flow.

In a preferred embodiment, the plate-like air directing vanes abut the front wall of the combustion air housing and extend therefrom inwardly and rearwardly along inner edge portions such that the space between inner edge portions of adjacent vanes decreases in a direction from the front wall toward the rear wall. The inner edge portions of the vane array thereby define a generally conical open volume having its base lying along the front wall opening and tapering towards the rear wall of the housing.

It is therefore an object of the present invention to provide a variable capacity burner assembly of the type wherein combustion air is discharged into a combustion zone after having imparted thereto a rotary, swirling motion, said assembly further including the capability for varying the volume of combustion air so discharged while maintaining effective rotary, swirling motion in the air.

It is a further object of the present invention to provide a burner assembly as described in the prededing paragraph which includes a circular array of air directing vanes for imparting said rotary, swirling motion and wherein a generally planar baffle member having an array of slots therein in registry with said air directing vanes is provided for axial displacement along said vanes in order to provide the aforementioned combustion air volume control.

It is yet a further object of the present invention to provide a burner assembly as described wherein the air directing vanes include inner edge portions which extend inwardly and rearwardly from their front edges such that the space between inner edge portions of adjacent vanes decreases in a direction from the front wall toward the rear wall, defining at their interior an open, generally conical volume which is truncated by axial displacement of the generally planar baffle member as it controls the volume of combustion air passing through said vanes.

These and other objects of the invention will become apparent from the following description of a preferred embodiment and by reference to the accompanying drawings.

DESCRIPTION OF A PREFERRED EMBODIMENT

Figure 1:
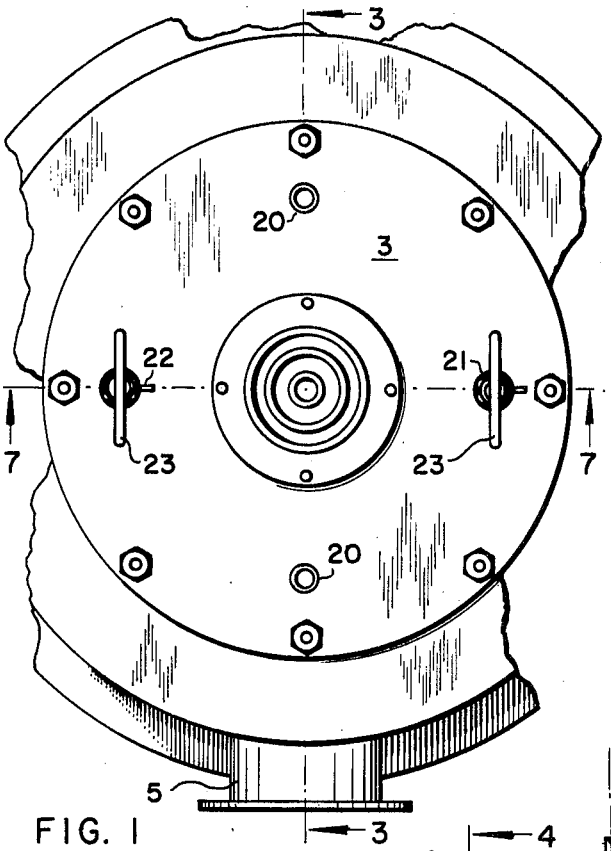
FIG. 1 is a rear view of the burner assembly constructed in accordance with the present invention.
Figure 2:
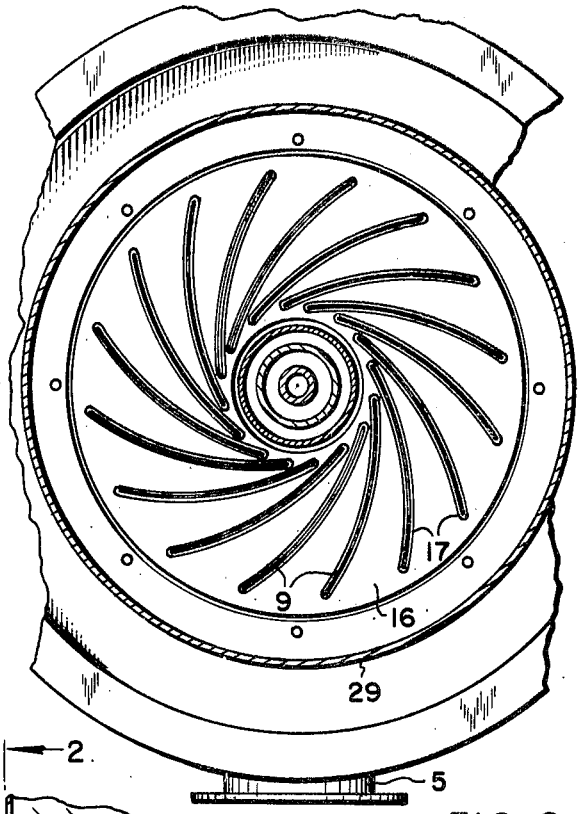
FIG. 2 is a cross-sectional view taken along the line 2—2 of FIG. 3.
Figure 3:
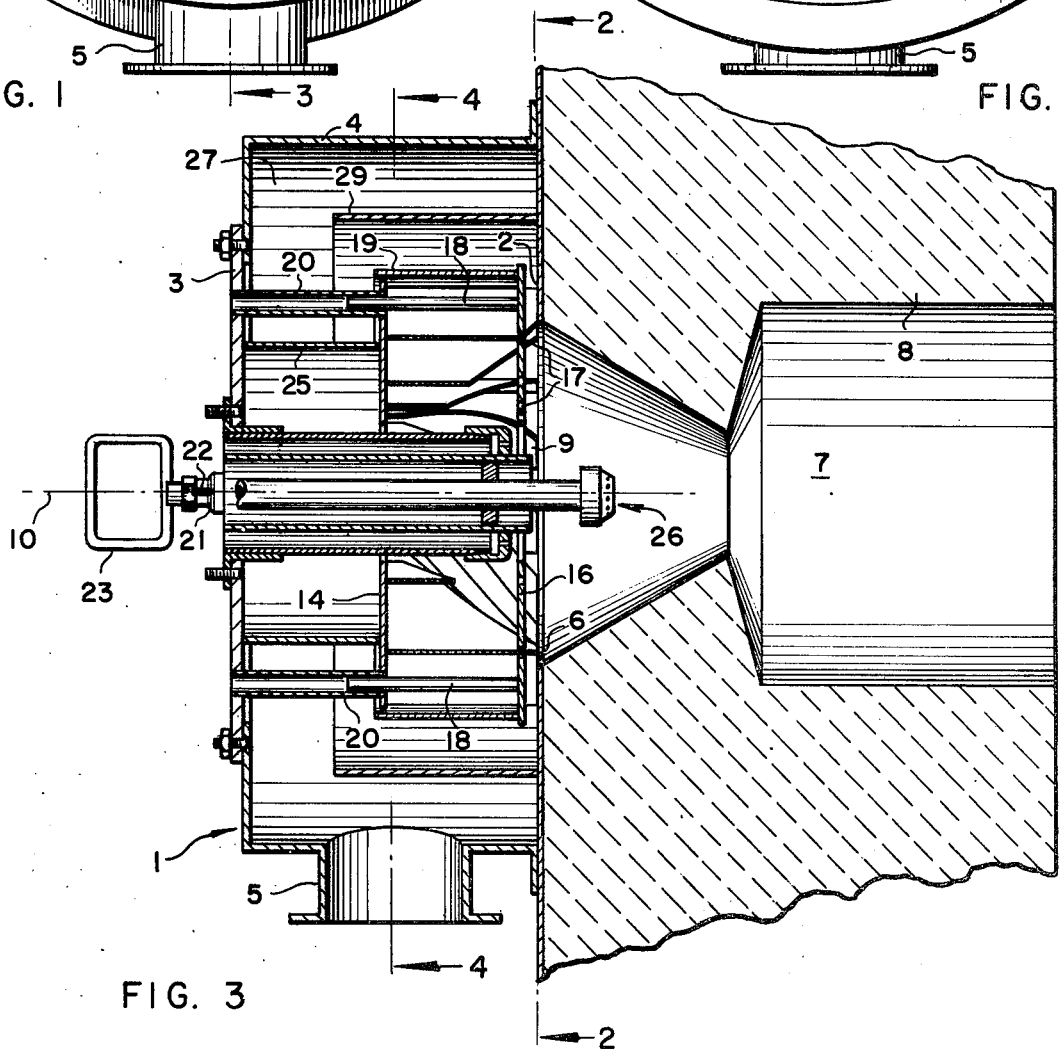
FIG. 3 is a cross-sectional view taken along the line 3—3 of FIG. 1 showing the baffle members in a position providing reduced capacity.

Turning now to the drawings, reference may be had to FIG. 3 wherein the variable capacity burner assembly of the present invention is illustrated in cross section. As shown, the assembly includes a combustion air supply housing shown generally at 1, having spaced front and rear walls 2 and 3, respectively, with side wall means 4 extending therebetween. As is evident from FIGS. 1 and 2 of the drawings, front wall 2 and rear wall 3 are of generally planar, circular configuration and side wall means 4 comprise a circumferential side wall extending between peripheral portions of the front and rear walls. Suitable means are provided at 5 for admitting combustion air to housing 1. In practice, means 5 would be connected with a suitable supply of combustion air under pressure, such as a fan or blower. Combustion air is discharged from housing 1 by way of an opening 6 in front wall 2. In the preferred embodiment, opening 6 is circular and centrally located within front wall 2.

When installed, the burner assembly of the present invention is associated with a combustion zone shown generally at 7 which is formed within a mass of suitable high temperature refractory material as shown at 8. Combustion zone 7 includes an initial, inwardly tapered portion wherein combustion air and fuel are mixed, then expanding into a larger volume, as is conventional and known in the art.

Figure 4:
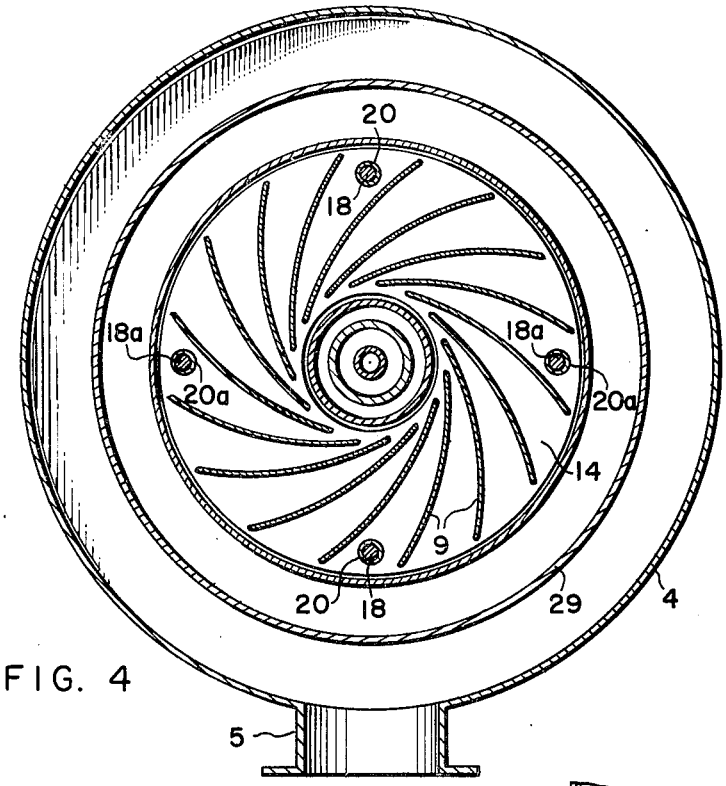
FIG. 4 is a cross-sectional view taken along the line 4—4 of FIG. 3.

In burner assemblies of the type under consideration, it is preferable that combustion air entering the combustion zone have imparted thereto a rotary, swirling motion in order to promote intense and efficient mixing of the fuel and combustion air. This result is brought about by the provision of a plurality of plate-like air directing vanes 9 which are disposed within the enclosed chamber 27 formed by combustion air supply housing 1. As best illustrated in FIGS. 2, 3, and 4, air directing vanes 9 are arranged in a circular array about an imaginary line 10 which extends from a central portion of opening 6 toward rear wall 3. In the preferred embodiment, reference axis 10 intersects the center of circular opening 6 and extends perpendicular to front wall 2 toward rear wall 3, thereby defining a central axis of combustion air supply housing 1.

From FIGS. 2 and 4, it is apparent that each air directing vane 9 has its surface lying generally tangentially with respect to the surface of an imaginary circular cylinder lying along reference axis 10. Since the front edge 11 (See FIG. 5) of each air directing vane is in abutment with front wall 2, encircling opening 6, the desired rotary, swirling motion is imparted to combustion air passing between adjacent vanes of the array prior to its discharge through opening 6.

Figure 6:
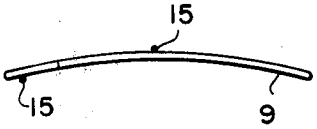
FIG. 6 is an end view of a single vane as used in the present invention.
Figure 5:
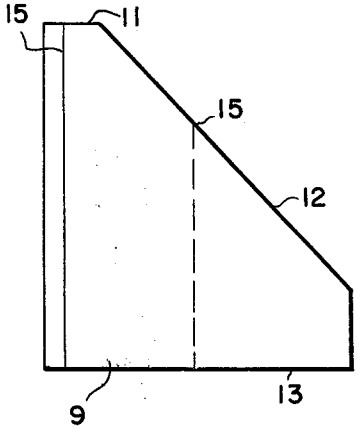
FIG. 5 is a plan view of a single vane as used in the present invention.

The preferred shape for air directing vanes 9 is most clearly shown in FIGS. 5 and 6 wherein a single vane is illustrated. Each vane thus comprises a front edge 11 which abuts against front wall 2, and an inner edge portion 12 which, as best seen in FIG. 3, extends inwardly towards reference axis 10 and rearwardly toward rear wall 3 such that the space between inner edge portions 12 of adjacent vanes decreases in a direction from front wall 2 toward rear wall 3. This design has been found to produce desirable combustion air flow characteristics from the standpoint of efficiency and in maintaining a uniform rotary, swirling motion within the combustion air as it is discharged into combustion zone 7.

Returning now to FIGS. 5 and 6, it may be noted that each vane 9 includes a rear edge 13 generally parallel to its front edge 11, the rear edge being affixed to a generally planar support member 14 within combustion air supply housing 1. The cross-section view of FIG. 6 illustrates two further features of air directing vanes 9, the first of which relates to the curved shape of the vane when viewed in a cross section taken along a plane perpendicular to reference axis 10. The second feature, which is also apparent from FIGS. 2 and 4, is that the surface of each air directing vane 9 is defined entirely by elements extending parallel to reference axis 10. To illustrate this concept, two imaginary surface elements 15 have been drawn on vane 9 as illustrated in FIGS. 5 and 6. This feature is important as it relates to flow control means associated with the burner assembly as will be hereinafter described.

The array of air directing vanes 9 as described above define at their interior an open volume of generally conical shape symmetrically disposed about reference axis 10, having its base lying along opening 6 and converging toward rear wall 3.

Figure 7:
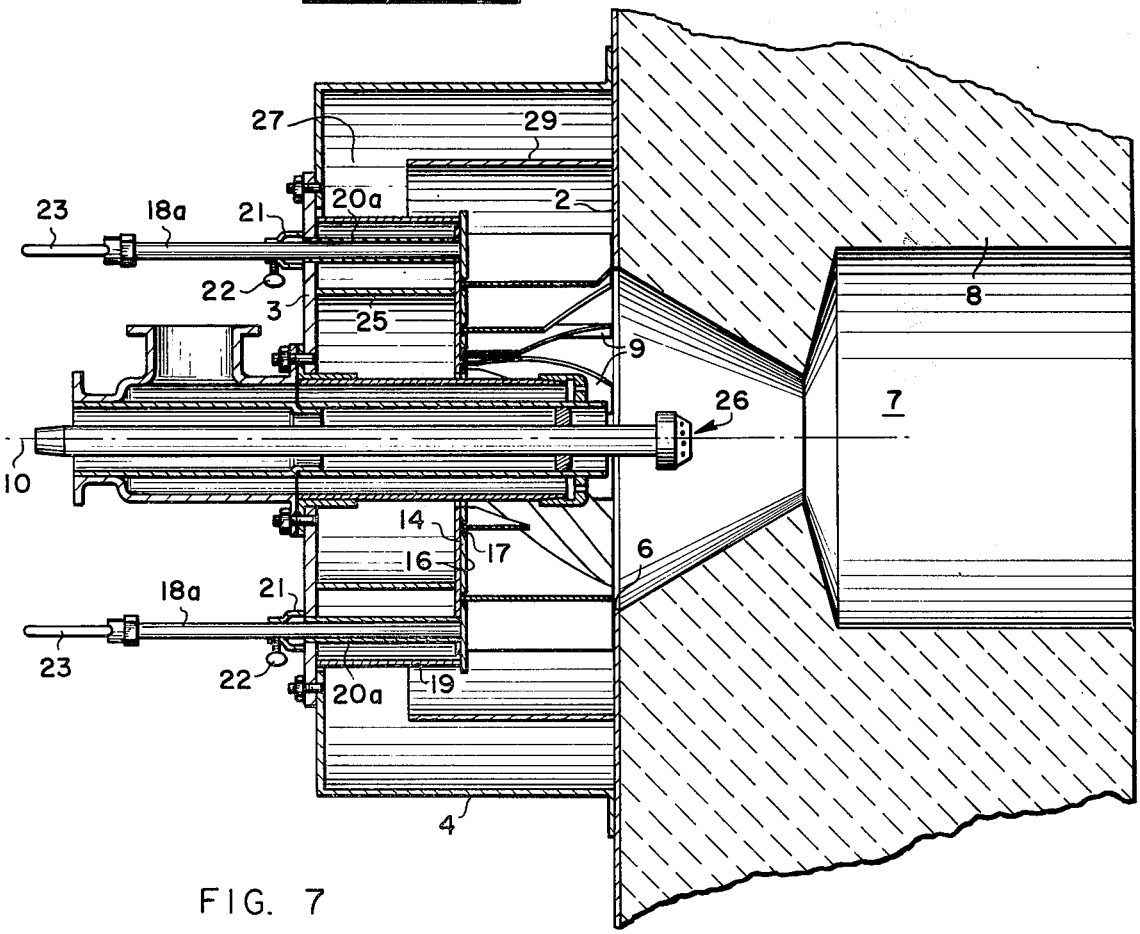
FIG. 7 is a cross-sectional view taken along the line 7—7 of FIG. 1 showing the baffle members in a position providing full capacity.

Returning now to FIG. 3, the above-mentioned flow control means associated with the burner assembly will be described. A generally planar baffle member 16 is disposed substantially perpendicular to reference axis 10 and includes a circular array of slots 17 therein corresponding to the array of air directing vanes 9. As shown, vanes 9 are in registry with slots 17, said slots conforming to the size and shape of vanes 9 at their rear edge 13. Means are provided for supporting planar baffle member 16 for axial displacement within enclosed chamber 27 between a first position adjacent front wall 2 wherein combustion air flow through vanes 9 is limited to a minimum value, and a second position spaced from front wall 2, as shown in FIG. 7, wherein maximum combustion air flow through the vanes is affected. In this manner, the heat output of the burner assembly may be modulated between said minimum and maximum values during operation while maintaining the effectivenss of the rotary, swirling motion imparted to the combustion air flow.

The flow control means further include a generally cylindrical baffle member 19 which is attached to generally planar baffle member 16 at its outer periphery and extends axially therefrom toward rear wall 3, in surrounding relationship to the array of air directing vanes. In the preferred embodiment, planar baffle member 16 comprises a circular member and cylindrical baffle member 19 conforms to the circular configuration thereof.

It should be appreciated that, as baffle members 16 and 19 are displaced axially toward rear wall 3, an increasing flow area is provided about the periphery of air directing vanes 9 between front wall 2 and baffle member 16, thereby resulting in increased combustion air flow through the array of vanes and opening 6 to combustion zone 7. A burner designed in accordance with the present invention has exhibited the capability to vary combustion air flow between 10% and 100% of the burner assembly's rated capacity, while maintaining effective rotary, swirling motion within the combustion air.

Baffle members 16 and 19 are supported within chamber 27 by a plurality of support elements 18, 18*a* (See FIGS. 3 and 7) slidably engaging tubular members 20, 20*a* which are supported from rear wall 3 of housing 1. As shown, support elements 18, 18*a* are fastened directly to planar baffle member 16, as by welding, although it is possible that such elements could be affixed to cylindrical baffle member 19 without departing from the scope of the invention.

In order to provide for operation of the flow control means, support elements 18*a* extend through rear wall 3 and terminate in suitable actuator means such as handles 23 for the manual actuation of baffle members 16 and 19. Although only a simple, manually operated burner assembly is shown, it is possible that suitable automatically controlled actuator means could be substituted therefor, such as hydraulically or electrically operated means. A collar 21 surrounds elements 18*a* at the external side of rear wall 3 and includes suitable means for locking elements 18*a* in a desired position. As illustrated, such means may comprise a simple set screw 22 threadably engaging collar 21.

As best seen in FIGS. 3 and 7, a generally planar support member 14 is provided for supporting air directing vanes 9. Planar support member 14 is, in turn, supported from the rear wall of housing 1 by means of a cylindrical support member 25. As is apparent from the drawings, planar support member 14 and its associated support 25 do not extend outwardly to an extent such that they would interfere with axial displacement of cylindrical baffle member 19.

Shown generally at 26 in FIGS. 3 and 7 are suitable conduit means for the admission of fuel to combustion zone 7. The particular conduit means illustrated comprise a combination gas/oil injector of conventional construction wherein either a mixture of steam and fuel is injected into the combustion zone via its central nozzle, or gaseous fuel is injected through the annular chamber as shown. As is conventional, conduit means 26 is supported by rear wall 3 of the burner assembly through the use of suitable threaded fasteners. That portion of conduit means 26 extending rearwardly of rear wall 3 has been omitted from FIG. 3 for the sake of clarity in order that the actuator means 23 be more clearly illustrated.

Also disposed within combustion air supply housing 1 is a cylindrical combustion air baffle 29 which extends rearwardly from front wall 2 for insuring the even distribution of combustion air about the periphery of the array of air directing vanes 9.

While the invention has been described with respect to a preferred embodiment, it is to be understood that modifications thereto will be apparent to those skilled in the art within the scope of the invention, as defined in the claims which follow.

I claim:

1. A variable capacity burner assembly for the combustion of a fuel-air mixture comprising a. a combustion air supply housing having spaced front and rear walls and side wall means extending therebetween to form an enclosed chamber, means for admitting combustion air to said chamber and an opening in said front wall for discharge of combustion air into a combustion zone, an imaginary line extending from a central portion of said opening toward said rear wall defining a reference axis of said chamber;

b. a plurality of plate-like air directing vanes disposed within said chamber, said vanes being arranged in a circular array about said reference axis with the surface of each said vane lying generally tangentially with respect to the surface of an imaginary circular cylinder lying along said reference axis, front edges of said vanes being in abutment with said front wall and encircling said opening, whereby a rotary, swirling motion is imparted to combustion air passing between adjacent vanes of said array prior to its discharge through said opening, further comprising means for supporting said vanes within said chamber; and c. flow control means for varying the volume of combustion air passing through said vanes to said opening, including i. a generally planar baffle member disposed substantially perpendicular to said reference axis having a circular array of slots therein corresponding to said array of air directing vanes, said vanes being in registry with said slots; and ii. means supporting said generally planar baffle member for axial displacement between a first position adjacent said front wall wherein combustion air flow through said vanes is limited to a minimum value, and a second position spaced from said front wall wherein maximum combustion air flow through said vanes is effected, whereby the flow of combustion air from said chamber through said opening may be varied between said minimum and maximum values.

2. The variable capacity burner assembly of claim 1 wherein said flow control means further comprise a generally cylindrical baffle member attached to said generally planar baffle member and extending axially therefrom toward said rear wall in surrounding relationship to said array of vanes.

3. The variable capacity burner assembly of claim 2 wherein the surface of each said air directing vane lying between said first and second positions is defined entirely by elements extending parallel to said reference axis, whereby the slots of said generally planar baffle member may be formed so as to closely conform to the shape of said vanes while permitting axial displacement of said generally planar baffle member.

4. The variable capacity burner assembly of claim 1 wherein each said plate-like air directing vane includes an inner edge portion extending inwardly and rearwardly from its front edge, whereby the space between inner edge portions of adjacent vanes decreases in a direction from said front wall toward said rear wall, said vanes defining at the interior of said array an open volume of generally conical shape symmetrical about said reference axis, having its base lying along said opening and converging toward said rear wall, said generally planar baffle member being disposed substantially parallel to the base of said conical volume and acting to truncate same as it is axially displaced from said second position to said first position.

5. The variable capacity burner assembly of claim 4 wherein said plate-like vane members are curved when viewed in a cross-section taken along a plane perpendicular to said reference axis, curved surfaces of said vanes lying generally tangentially with respect to the surface of said imaginary circular cylinder.

6. The variable capacity burner assembly of claim 1 wherein the surface of each said air directing vane lying between said first and second positions is defined entirely by elements extending parallel to said reference axis, whereby the slots of said generally planar baffle member may be formed so as to closely conform to the shape of said vanes while permitting axial displacement of said generally planar baffle member.

7. The variable capacity burner assembly of claim 6 wherein said plate-like vane members are curved when viewed in a cross-section taken along a plane perpendicular to said reference axis, curved surfaces of said vanes lying generally tangentially with respect to the surface of said imaginary circular cylinder.

8. The variable capacity burner assembly of claim 1 wherein said means for supporting said vanes within said chamber includes a generally planar support member lying substantially perpendicular to said reference axis and having rear edges of said vanes affixed thereto.

9. The variable capacity burner assembly of claim 8 wherein said flow control means further comprise a generally cylindrical baffle member attached to said generally planar baffle member and extending axially therefrom toward said rear wall in surrounding relationship to said array of vanes and said generally planar support member.

10. The variable capacity burner assembly of claim 8 further comprising means for supporting said planar support member from the rear wall of said housing.

11. The variable capacity burner assembly of claim 1 wherein said means supporting said generally planar baffle member for axial displacement comprise a support element connected to said generally planar baffle member, said housing including means for carrying said support element in slidable relationship, whereby axial displacement of said generally planar baffle member is provided.

12. The variable capacity burner assembly of claim 11 wherein a portion of said support element is disposed outside said housing and includes actuator means for moving said planar baffle member between said first and second positions.

13. The variable capacity burner assembly of claim 11 wherein said support element comprises a rod extending through the rear wall of said housing and attached directly to said planar baffle member.

14. The variable capacity burner assembly of claim 11 including a plurality of said support elements.

15. The variable capacity burner assembly of claim 1 further comprising conduit means attached to said housing for the admission of fuel to said combustion zone, said conduit means lying along said reference axis and extending through the opening in said front wall, said generally planar baffle member including an opening therein for passage of said conduit means.

16. A variable capacity burner assembly for the combustion of a fuel-air mixture comprising a. a combustion air supply housing having spaced front and rear walls of generally planar, circular configuration and a circumferential side wall extending therebetween to form an enclosed chamber, means for admitting combustion air to said chamber, and a circular opening in said front wall for discharge of combustion air into a combustion zone, an imaginary line intersecting the center of said circular opening and extending perpendicularly to said front wall towards said rear wall defining a central axis of said chamber;

b. a plurality of plate-like air directing vanes disposed within said chamber, said vanes being arranged in circular array about said central axis with the surface of each said vane lying generally tangentially with respect to the surface of an imaginary circular cylinder lying along said central axis, each said vane including a front edge in abutment with said front wall adjacent said circular opening and an inner edge portion extending at an angle from said front edge inwardly towards said central axis and rearwardly toward said rear wall, whereby the space between inner edge portions of adjacent vanes decreases in a direction from said front wall toward said rear wall, said vanes defining at the interior of said array an open volume of generally conical shape symmetrical about said central axis, having its base lying along said central opening and converging towards said rear wall, whereby a rotary, swirling motion is imparted to combustion air passing between adjacent vanes of said array prior to its discharge through said opening;

c. a generally circular, planar support member lying substantially perpendicular to said central axis, spaced rearwardly from said front wall, rear edges of said vanes being attached thereto, and means supporting said planar support member from said rear wall;

d. flow control means for varying the volume of combustion air passing through said vanes to said opening, including i. a circular, generally planar baffle member disposed substantially perpendicular to said central axis having a circular array of slots therein corresponding to said array of air directing vanes, said vanes being in registry with said slots;

ii. a generally cylindrical baffle member attached to the periphery of said circular, generally planar baffle member and extending axially therefrom towards said rear wall in surrounding relationship to said array of vanes and said generally circular, planar support member;

iii. means supporting said circular, generally planar baffle member and said generally cylindrical baffle member for axial displacement between a first position adjacent said front wall wherein combustion air flow through said vanes is limited to a minimum value, and a second position spaced from said front wall wherein maximum combustion air flow through said vanes is effected, whereby the flow of combustion air from said chamber through said opening may be varied between said minimum and maximum values.

* * * * *